US008562380B2

(12) United States Patent
Li

(10) Patent No.: US 8,562,380 B2
(45) Date of Patent: Oct. 22, 2013

(54) TESTING APPARATUS HAVING A CONNECTING MEMBER MOVABLY LOCATED BETWEEN A SECURING MEMBER AND A PRESSING MEMBER AND HAVING A RESISTING MEMBER ON ONE END AND A RESILIENT MEMBER ON THE OTHER END

(75) Inventor: Zhan-Yang Li, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/483,289

(22) Filed: May 30, 2012

(65) Prior Publication Data

US 2013/0072043 A1 Mar. 21, 2013

(30) Foreign Application Priority Data

Sep. 21, 2011 (CN) ..... 2011 1 0281712

(51) Int. Cl.
*H01R 13/24* (2006.01)

(52) U.S. Cl.
USPC ..... 439/700

(58) Field of Classification Search
USPC ..... 439/700, 219, 352
See application file for complete search history.

(56) References Cited

U.S. PATENT DOCUMENTS

| | | | | |
|---|---|---|---|---|
| 5,490,797 | A * | 2/1996 | Durgin | 439/310 |
| 6,053,777 | A * | 4/2000 | Boyle | 439/700 |
| 6,159,056 | A * | 12/2000 | Boyle | 439/700 |
| 6,685,492 | B2 * | 2/2004 | Winter et al. | 439/219 |
| 7,322,846 | B2 * | 1/2008 | Camelio | 439/352 |
| 7,513,788 | B2 * | 4/2009 | Camelio | 439/352 |
| 7,682,206 | B2 * | 3/2010 | Kainz | 439/824 |
| 7,794,256 | B1 * | 9/2010 | Sochor | 439/289 |

* cited by examiner

*Primary Examiner* — Chandrika Prasad
(74) *Attorney, Agent, or Firm* — Altis & Wispro Law Group, Inc.

(57) ABSTRACT

A testing apparatus includes a securing member adapted to be attached to a connector, a pressing member, a connecting member, a resisting member, and a resilient member. The connecting member is moveably located between the securing member and the pressing member. The resisting member is aligned with a pin of the connector and attached to a first end of the connecting member. The resisting member is attached to a second opposite end of the connecting member. The pressing member is moveable relative to the securing member, and the resisting member abuts the pin of the connector.

17 Claims, 5 Drawing Sheets

TESTING APPARATUS HAVING A CONNECTING MEMBER MOVABLY LOCATED BETWEEN A SECURING MEMBER AND A PRESSING MEMBER AND HAVING A RESISTING MEMBER ON ONE END AND A RESILIENT MEMBER ON THE OTHER END

BACKGROUND

1. Technical Field

The present disclosure relates to testing apparatuses, more particularly to a testing apparatus for a connector.

2. Description of Related Art

Connectors are usually used in an electronic device for transferring signals between two electronic components. Generally, the connector includes a main body and a plurality of pins connected to the main body for engaging with the electronic component. If the pins are not securely engaged with the main body, the connector cannot transfer signals between the two electronic components. Therefore, a testing apparatus is needed to test the connection between the main body and the pins.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
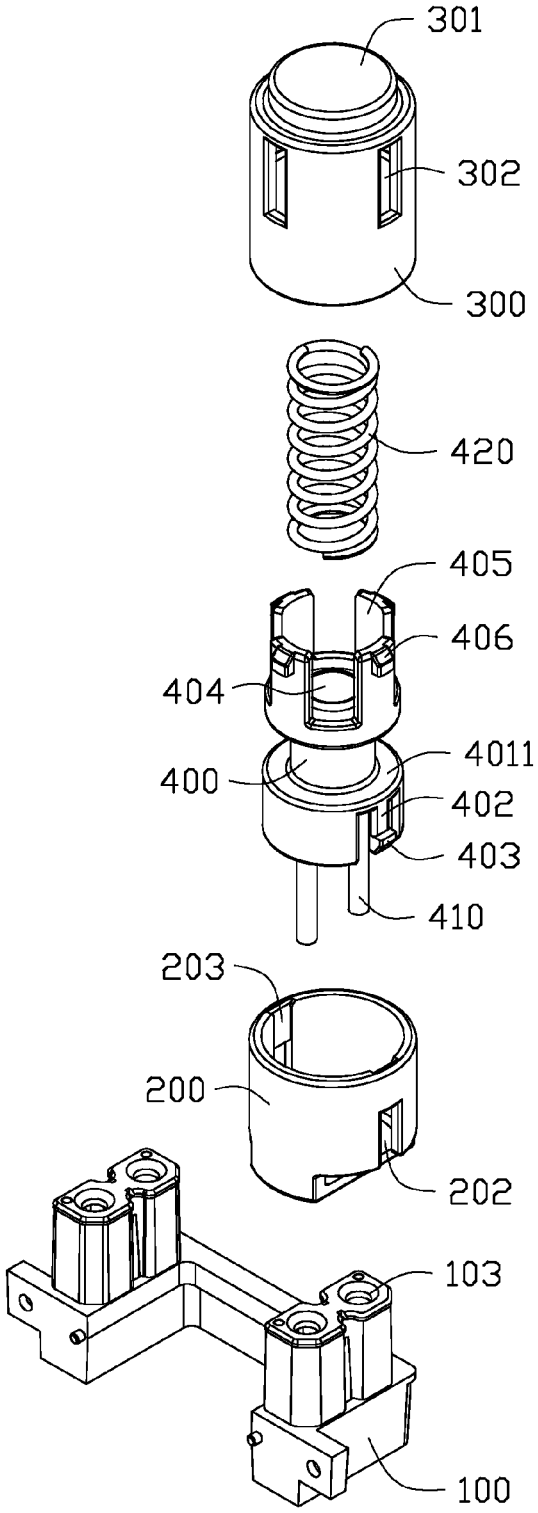
FIG. 1 is an exploded, isometric view of a testing apparatus for a connector in accordance with an embodiment.
Figure 2:
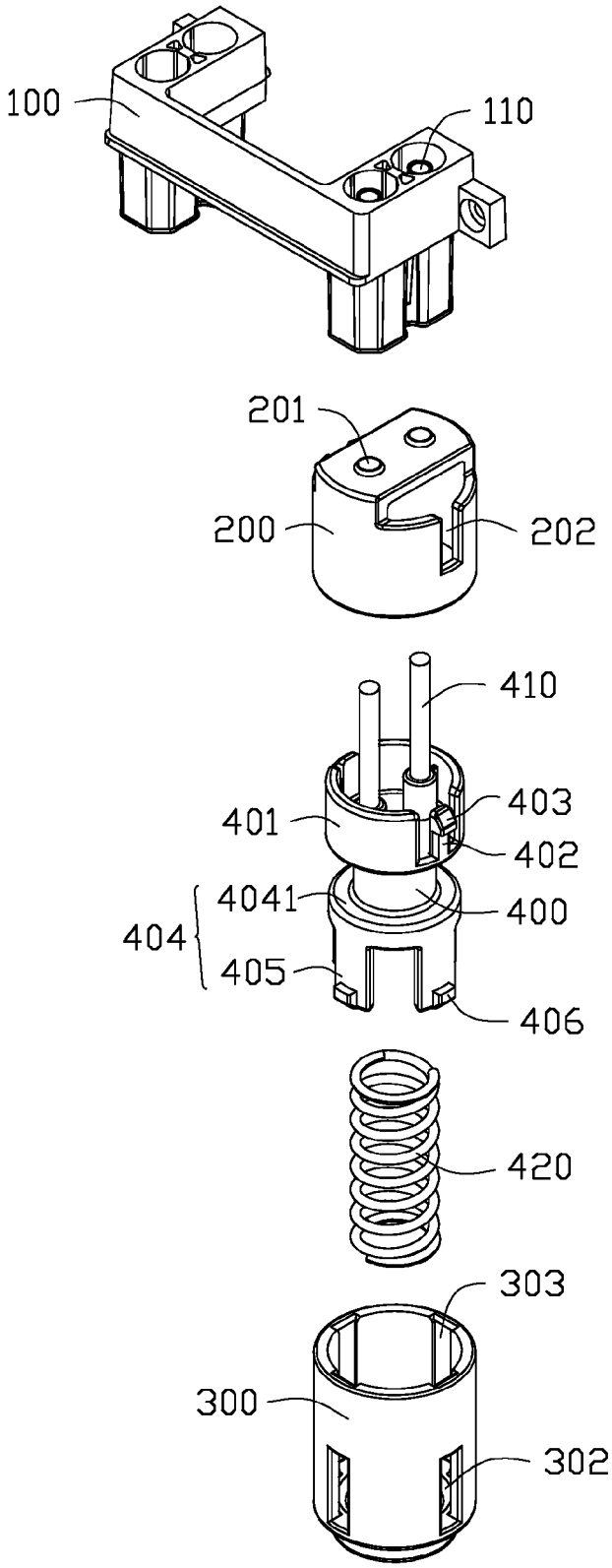
FIG. 2 is similar to FIG. 1, but viewed from a different aspect.

FIGS. 1 and 2, show a testing apparatus in accordance with an embodiment including a securing member 200, a pressing member 300, a connecting member 400 moveably located between the securing member 200 and the pressing member 300, two resisting members 410, and a resilient member 420. The testing apparatus is used to test the connection of pins 110 (shown in FIGS. 4-5) to a connector 100 (shown in FIGS. 4-5). In one embodiment, the securing member 200 is a column with a hole defined therein, and the pressing member 300 is a column with a hole defined therein. The resilient member 420 is a compression spring.

Two through holes 201 are defined in the bottom of the securing member 200. Two first longitudinal receiving slots 202 are defined in the securing member 200, and two first sliding slots 203 are defined in the inner surface of the securing member 20. Each of the two first sliding slots 203 is connected to an end of each of the first longitudinal receiving slots 202. In one embodiment, each of the two first longitudinal receiving slots 203 is U-shaped.

The pressing member 300 includes a protruding portion 301. Four second longitudinal receiving slots 302 are defined in the pressing member 300. Four second sliding slots 303 are defined in the inner surface of the pressing member 300, and each of the four second sliding slots 303 is connected to one four second longitudinal receiving slots 302. In one embodiment, each of the four second longitudinal receiving slots 302 is a rectangle.

A first accommodating member 401 is connected to a first end of the connecting member 400, and a second accommodating member 404 is connected to a second opposite end of the connecting member 400. In one embodiment, a cross-section of the connecting member 400, and the first and second accommodating member 401, 404 is round, a diameter of the connecting member 400 is less than a diameter of the first accommodating member 401, and the diameter of the first accommodating member 401 is substantially equal to a diameter of the second accommodating member 404. Two first extending arms 402, each with a first hook 403, extend from a first accommodating body 4011 of the first accommodating member 401. In one embodiment, the two resisting members 410 are received in the first accommodating member 401. The second accommodating member 404 includes a second accommodating body 4041 and four second extending arms 405 evenly spaced from each other and extending from the second accommodating body 4041. The second accommodating body 4041 is connected to the connecting member 400. Each of the four second extending arms 405 includes a second hook 406.

Figure 3:
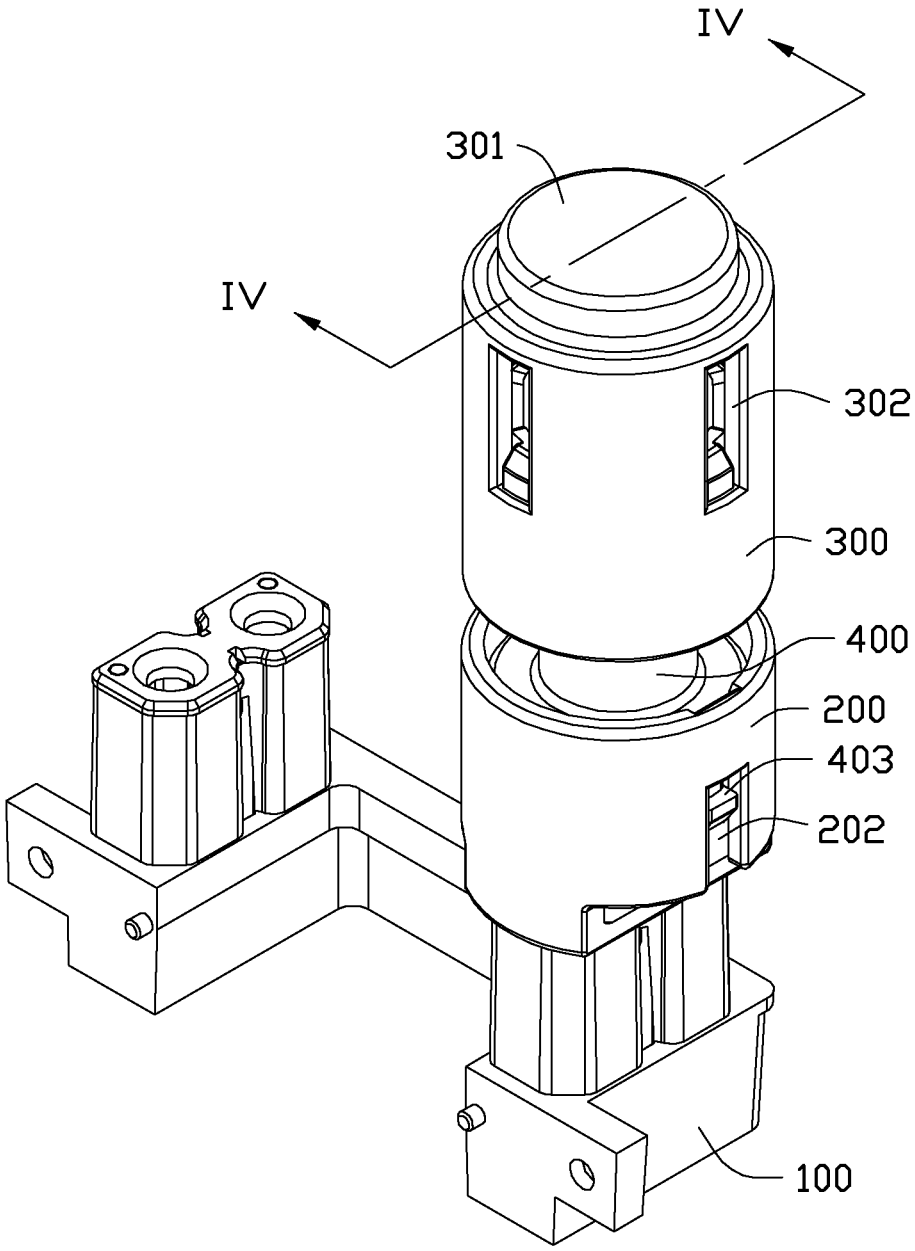
FIG. 3 is an assembled view of the testing apparatus of FIG. 1.

Referring to FIG. 3, in assembly, the two through holes 201 are aligned with the two resisting members 410, and the two first extending arms 402 are aligned with the two first sliding slots 203. The two resisting members 410 extend through the two first sliding slots 203, until the two first hooks 403 are engaged in the two first longitudinal receiving slots 202. Thus, the first accommodating member 401 can be secured to the securing member 200.

A first end of the resilient member 420 abuts the second accommodating member 404. The four second extending arms 405 are aligned with the four second longitudinal receiving slots 302. The four second hooks 406 slide along the four second sliding slots 303 to engage in the four second longitudinal receiving slots 302. Therefore, the pressing member 300 is secured to the connecting member 400, and a second opposite end of the resilient member 420 abuts the protruding portion 301.

Figure 4:
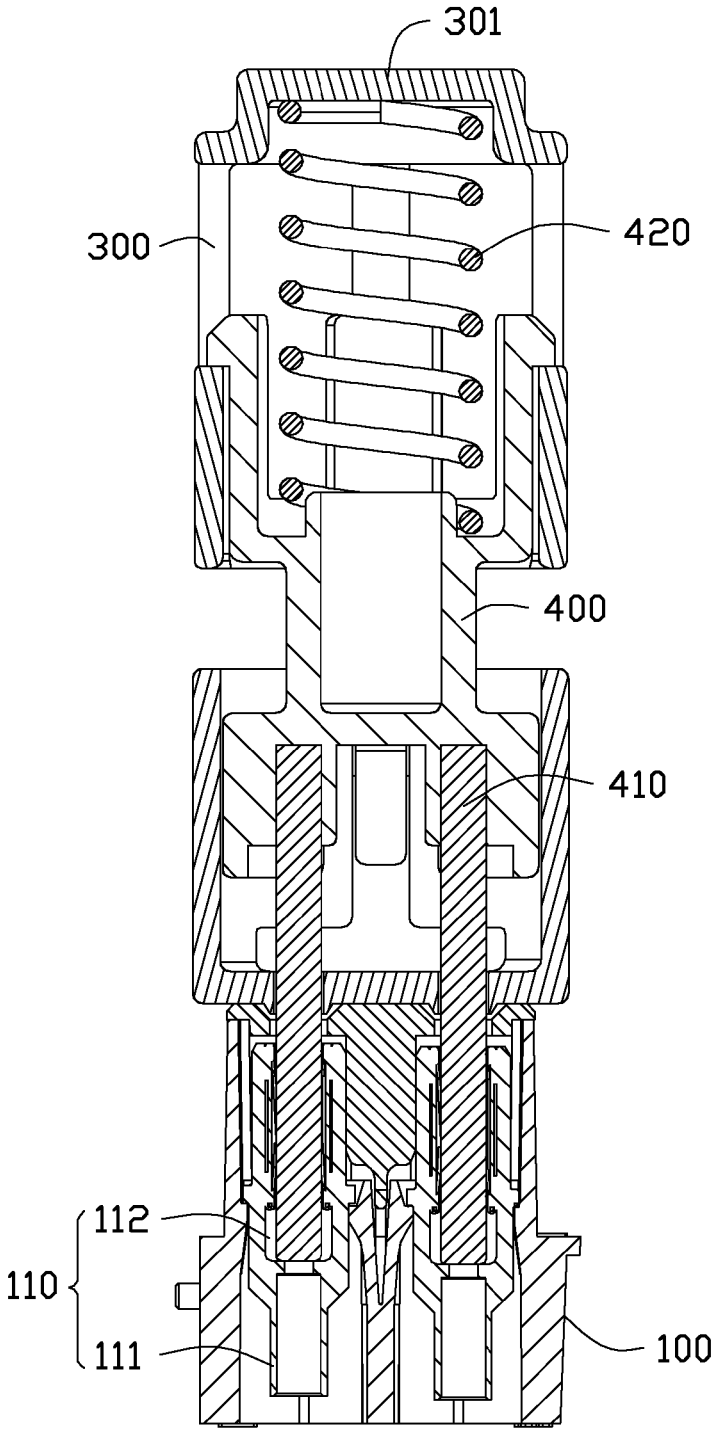
FIG. 4 is a cross-sectional view of the testing apparatus of FIG. 3 shown in one state, taken along a line IV-IV.
Figure 5:
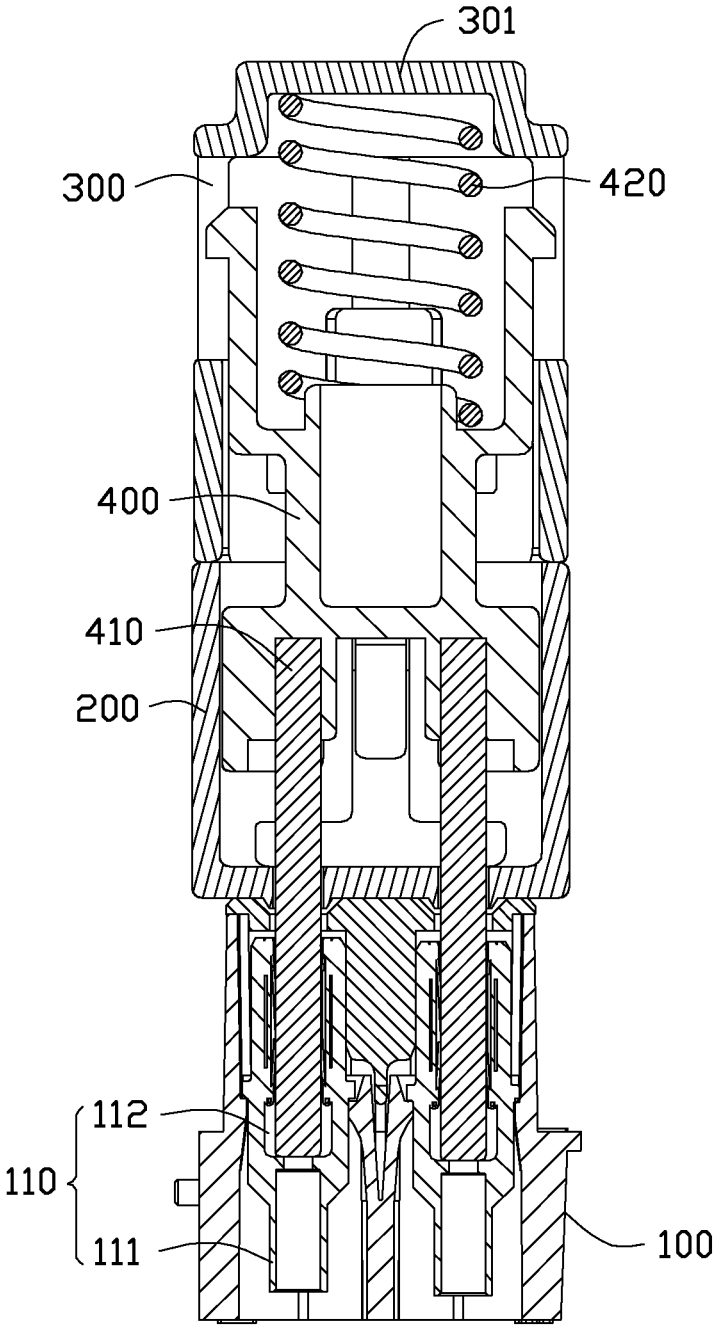
FIG. 5 is similar to FIG. 4, but shown in a different state.

Referring to FIGS. 4 and 5, the pin 110 includes a first portion 111 and a second portion 112 connected to the first portion 111. The first portion 111 has a smaller diameter than a diameter of the second portion 112. A shoulder hole 103 is defined between the first portion 111 and the second portion 112. In one embodiment, a diameter of the second portion 112 is substantially equal to that of each of the resisting members 410.

In use, the two resisting members 410 are inserted into the shoulder hole 103 to abut the first portion 111. The securing member 200 abuts the connector 100. The protruding portion 301 is pressed to move the pressing member 300 towards the securing member 200, to deform the resilient member 420, until the pressing member 300 abuts the securing member 200. The two resisting members 410 drive the first portion 111. If the pin 110 is unstably connected to the connector 100, the pin 110 will disengage from the connector 100 under pressure from the resisting members 410.

It is to be understood, however, that even though numerous characteristics and advantages have been set forth in the foregoing description of embodiments, together with details of the structures and functions of the embodiments, the disclosure is illustrative only and changes may be made in detail, especially in matters of shape, size, and arrangement of parts within the principles of the disclosure to the full extent indicated by the broad general meaning of the terms in which the appended claims are expressed.

What is claimed is:

1. A testing apparatus for a connector, the testing apparatus comprising:

a securing member adapted to be attached to the connector;

a pressing member;

a connecting member moveably located between the securing member and the pressing member;

a resisting member attached to a first end of the connecting member; and a resilient member attached to a second end of the connecting member;

wherein the resisting member is adapted to be aligned with a pin of the connector, the first end of the connecting member is opposite the second end of the connecting member, the pressing member is moveable relative to the securing member, and the resisting member abuts the pin of the connector.

2. The testing apparatus of claim 1, further comprising a first accommodating member connected to the first end of the connecting member and a second accommodating member connected to the second end of the connecting member, wherein the resisting member is received in the first accommodating member, and the resilient member is attached to the second accommodating member.

3. The testing apparatus of claim 2, wherein a diameter of the connecting member is less than a diameter of the first accommodating member, and the diameter of the first accommodating member is substantially equal to a diameter of the second accommodating member.

4. The testing apparatus of claim 2, wherein the first accommodating member comprises a first accommodating body and a first extending arm extending from the first accommodating body, a first receiving slot is defined in the securing member, and the first extending arm is slidably engaged in the first receiving slot.

5. The testing apparatus of claim 4, wherein a first sliding slot, communicating with the first receiving slot, is defined in an inner surface of the securing member, the first accommodating member further comprises a first hook located on a free end of the first extending arm, and the first extending arm extends through the first sliding slot until the hook engages with the first receiving slot.

6. The testing apparatus of claim 4, wherein the first receiving slot is U-shaped.

7. The testing apparatus of claim 2, wherein the second accommodating member comprises a second accommodating body connected to the connecting member and at least two second extending arms evenly extending from the second accommodating body, the pressing member defines at least two second receiving slots, and the at least two extending arms are slidably received in the at least two second receiving slots.

8. The testing apparatus of claim 7, wherein the pressing member comprises a protruding portion, a first end of the resilient member is attached to the protruding portion, and a second opposite end of the resilient member is attached to the second accommodating body.

9. The testing apparatus of claim 1, wherein the resilient member is a compression spring.

10. A testing apparatus for a connector, the testing apparatus comprising:

a securing member adapted to be attached to the connector;

a pressing member;

a connecting member;

a first accommodating member connected to a first end of the connecting member;

a second accommodating member connected to a second end of the connecting member;

a resisting member attached to the first accommodating member, and a resilient member located between the second accommodating member and the pressing member;

wherein the first accommodating member is moveably attached to the securing member; the second accommodating member is moveably attached to the pressing member; the pressing member is moveable relative to the securing member between a first position and a second position; in the first position, the resisting member is aligned with a pin of the connector, the connecting member is exposed, and a gap is defined between the pressing member and the securing member; in the second position, the pressing member is attached to the securing member, the resilient member is compressed; and the resisting member urges the pin of the connector.

11. The testing apparatus of claim 10, wherein a diameter of the connecting member is less than a diameter of the first accommodating member, and the diameter of the first accommodating member is substantially equal to a diameter of the second accommodating member.

12. The testing apparatus of claim 11, wherein the first accommodating member comprises a first accommodating body and a first extending arm extending from the first accommodating body, a first receiving slot is defined in the securing member, and the first extending arm is slidably engaged in the first receiving slot.

13. The testing apparatus of claim 12, wherein a first sliding slot, communicating with the first receiving slot, is defined in an inner surface of the securing member, the first accommodating member further comprises a first hook located on a free end of the first extending arm, and the first extending arm extends through the first sliding slot until the hook engages with the first receiving slot.

14. The testing apparatus of claim 12, wherein the first receiving slot is U-shaped.

15. The testing apparatus of claim 10, wherein the second accommodating member comprising a second accommodating body connected to the connecting member and at least two second extending arms evenly spaced from each other and extending from the second accommodating body, the pressing member defines at least two second receiving slots, and the at least two extending arms are slidably received in the at least two second receiving slots.

16. The testing apparatus of claim 15, wherein the pressing member comprises a protruding portion, a first end of the resilient member is attached to the protruding portion, and a second opposite end of the resilient member is attached to the second accommodating body.

17. The testing apparatus of claim 10, wherein the resilient member is a compression spring.

* * * * *